United States Patent [19]

Hutchison

[11] 4,427,563

[45] Jan. 24, 1984

[54] STABILIZATION OF HYDROCRACKED OILS WITH CERTAIN DIHYDROXY DIPHENYL OXIDATION STABILIZERS

[75] Inventor: David A. Hutchison, Hammond, Ind.

[73] Assignee: Atlantic Richfield Company, Philadelphia, Pa.

[21] Appl. No.: 150,012

[22] Filed: May 15, 1980

[51] Int. Cl.[3] ..... C10M 1/20

[52] U.S. Cl. ..... 252/52 R; 252/404

[58] Field of Search ..... 252/52 R

[56] References Cited

U.S. PATENT DOCUMENTS

| | | | |
|---|---|---|---|
| 2,479,948 | 8/1949 | Luten, Jr. et al. | 252/52 R X |
| 2,570,402 | 10/1951 | Stevens et al. | 252/52 R |
| 2,785,188 | 3/1957 | Coe | 252/52 R X |
| 3,234,285 | 2/1966 | Moss et al. | 252/52 R X |
| 3,251,801 | 5/1966 | Boag | 252/52 R X |
| 3,520,809 | 7/1970 | Sparks | 252/52 R |
| 3,530,069 | 9/1970 | O'Neil | 252/52 R X |
| 3,692,679 | 9/1972 | O'Neil | 252/52 R X |

*Primary Examiner*—Andrew Metz

*Attorney, Agent, or Firm*—Frank J. Uxa

[57] ABSTRACT

Hydrocracked lubricating oils are effectively stabilized against deterioration caused by light by the inclusion of at least one of certain dihydroxy-diphenyl components. Such components, e.g., 4,4'-bis(2,6-di-tertiary butyl phenol), provide outstanding inhibition to sunlight deterioration.

19 Claims, No Drawings

STABILIZATION OF HYDROCRACKED OILS WITH CERTAIN DIHYDROXY DIPHENYL OXIDATION STABILIZERS

The invention relates to a method of stabilizing a hydrocracked oil. More particularly, it relates to stabilizing such oils against light deterioration by adding thereto at least one of certain dihydroxy-diphenyl components.

It is known that oils in general will degrade slowly in the presence of light. Oils such as the economically valuable hydrocracked lubricating oils used in his invention, degrade in light, especially in the presence of air. Since the hydrocracked oils are valuable, there has been considerable effort to find ways to prevent their breakdown due to light.

U.S. Pat. No. 4,036,770 teaches a method for stabilizing hydrocracked oils which involves adding nitro-containing aromatic amine components. Such components are relatively expensive and therefore may add significantly to the cost of the hydrocracked oils. Also, such components may impart a less than desirable color and/or odor to the final product.

U.S. Pat. No. 4,101,430 teaches that oxidative degradation of lubricant compositions containing certain organo sulfur-containing nickel complexes is inhibited.

U.S. Pat. Nos. 2,785,188 and 3,156,543 teach the use of 3,3'-5,5'-tetra alkyl-4,4'dihydroxy diphenyls as oxidation stabilizers for hydrocarbon fuels, such as gasoline. U.S. Pat. No. 3,156,543 discloses that 4,4' bis (2-isopropyl-6-tert-butylphenol) is a light yellow crystalline substance and is highly soluble in gasoline, diesel fuel and lubricating oil. However, neither of these references teach either inhibition of deterioration from light exposure or hydrocracked lubricating oils.

One object of the present invention is to provide an improved method for stabilizing hydrocracked lubricating oils against the deteriorating effects of light.

Another object of the invention is to provide an improved composition of matter involving a hydrocracked lubricating oil which has improved inhibition against deterioration by light. Other objects and advantages of the present invention will become apparent hereinafter.

An improved hydrocracked oil composition has now been discovered. This composition comprises a major amount, preferably at least about 70%, by weight of a hydrocracked lubricating oil and a minor amount by weight of at least one added dihydroxy-diphenyl component having a structure:

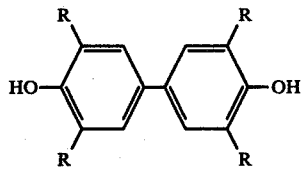

wherein each R is independently selected from the group consisting of substantially monovalent hydrocarbonaceous radicals containing 1 to about 24, preferably 1 to about 14 and more preferably 1 to about 10, carbon atoms.

It is preferred that the hydrocarbonaceous radicals be substantially saturated aliphatic radicals. Also, it is preferred that each of the R groups include at least one tertiary carbon atom. More preferably, each of the R groups has the same structure and, still more preferably, each of the R groups is a tertiary butyl group.

In a preferred embodiment, the added dihydroxy-diphenyl component comprises about 0.005% to about 2.0% more preferably, about 0.01% to about 1.0% and still more preferably about 0.01% to about 0.5%, by weight of the total composition.

The term "hydrocracked lubricating oil" means an oil, preferably a mineral oil, of lubricating viscosity which is derived from a lubricating oil produced by contacting a hydrocarbon feedstock with hydrogen, preferably in the presence of catalyst effective to promote hydrocracking, at hydrocarbon hydrocracking conditions to produce an oil of lubricating viscosity having an increased viscosity index relative to the viscosity index of the hydrocarbon feedstock. In addition, the hydrocracked lubricating oil may be subjected to additional processing, e.g., further contacting with hydrogen-again preferably in the presence of an effective catalyst-, other purifying procedures and the like, to further improve the quality, e.g., color, of the hydrocracked lubricating oil. For example, hydrocracked lubricating oils useful in the present invention may be obtained by the processes disclosed in U.S. Pat. No. 3,642,610, the specification of which is hereby incorporated by reference herein.

Typical examples of the substantially monovalent hydrocarbonaceous radicals from which R may be selected includes alkyl, such as methyl, ethyl, propyl, butyl, pentyl, hexyl (including cyclohexyl), octyl, decyl, dodecyl, hexadecyl, stearyl and the like; alkenyl such as ethylenyl, propenyl, butenyl, oleyl, linoleyl and the like; aryl, such as phenyl, benzyl and the like; alkaryl such as methyl phenyl, ethyl phenyl, butyl phenyl, octyl phenyl, stearyl phenyl and the like; alkenaryl such as ethylenyl phenyl, octenyl phenyl, oleyl phenyl and the like; aralkyl such as phenyl ethyl, phenyl octyl, phenyl stearyl and the like; and aralkenyl such as phenyl ethylenyl, phenyl butenyl, phenyl octenyl, phenyl oleyl and the like. As noted above, it is preferred that such hydrocarbonaceous radicals be substantially saturated.

By "substantially hydrocarbonaceous" radical is meant those radicals which are composed mainly of hydrogen and carbon, and include such radicals which contain, in addition, minor amounts of substituents, such as chlorine, bromine, sulfur, nitrogen and the like, which do not substantially affect their hydrocarbon character. Preferably, such substantially hydrocarbonaceous radicals include only carbon and hydrogen atoms.

The presently useful dihydroxy-diphenyl may be produced using procedures well known in the art. See, for example, U.S. Pat. No. 2,785,188 and 3,156,543.

The following examples illustrate more clearly the compositions and methods of the present invention. However, these illustrations are not to be interpreted as specific limitations on this invention.

EXAMPLES

These examples illustrate certain of the advantages of the present invention.

Two commercially available hydrocracked oils of lubricating viscosity were selected for testing. These hydrocracked oils had the following properties.

| | Hydrocracked Oil A | Hydrocracked Oil B |
|---|---|---|
| Initial Boiling | >600 | 604 |

-continued

| | Hydrocracked Oil A | Hydrocracked Oil B |
|---|---|---|
| Point, °F. | | |
| Viscosity, SUS at 100° F. | 156.0 | 113.3 |
| Viscosity Index | 106 | 98 |

These two oils were derived using well known lube oil hydrocracking processes.

Varying amounts of 4,4'-bis(2,6-ditertiary butyl phenol) were blended into samples of each of the hydrocracked oils. In order to determine the susceptibility of the oils and blends to light deterioration, 10 gram samples were placed in 250 ml. beakers and exposed to two (2) 275 watt U.V. sunlamps at seven (7) inches on a rotating table for a period of fifteen (15) hours. After the fifteen (15) hour exposure period, each of the samples was processed to determine the amount of solids (sludge) formation. The following results were obtained:

| | 4,4'bis (2,6-ditertiary butyl phenol), Wt. % | Solids After Exposure mg./gm. oil |
|---|---|---|
| Hydrocracked Oil A | | |
| Sample 1 | 0.00 | 1.23 |
| 2 | 0.05 | 0.17 |
| 3 | 0.10 | 0.05 |
| 4 | 0.20 | 0.03 |
| Hydrocracked Oil B | | |
| Sample 5 | 0.00 | 1.13 |
| 6 | 0.05 | 0.03 |
| 7 | 0.10 | 0.03 |
| 8 | 0.20 | 0.02 |

A series of three additional compositions were blended using Hydrocracked Oil A and 4,4'methylene bis (2,6-ditertiary butyl phenol). These three compositions were tested using the above-described procedure and the following results were obtained:

| Hydrocracked Oil A | 4,4'methylene bis (2,6-ditertiary butyl phenol) Wt. % | Solids After Exposure mg./gm. oil |
|---|---|---|
| Sample 9 | 0.05 | 1.23 |
| 10 | 0.10 | 1.21 |
| 11 | 0.20 | 0.94 |

These results indicate that hydrocracked lubricating oil alone is susceptible to deterioration by sunlight.

The dihydroxy-diphenyl components, as set forth in the present invention, are shown to provide substantial inhibition of deterioration of hydrocracked oil by sunlight. Clearly, such results are surprising, particularly in view of the relatively small amount of such dihydroxy-diphenyl components used. Further, the present components are shown to be substantially more effective than compounds with similar chemical structures, e.g., 4,4'-methylene bis (2,6-ditertiary butyl phenol). In addition, such dihydroxy-diphenyl components impart little or no distasteful odor to the hydrocracked oil compositions. This is in significant contrast to (and is a substantial benefit relative to) compositions which include various of the nitrogen-containing materials which have been suggested by the prior art for inhibiting light deterioration of hydrocracked oils.

While this invention has been described with respect to various specific examples and embodiments, it is to be understood that the invention is not limited thereto and that it can be variously practiced within the scope of the following claims:

The embodiments of the invention in which an exclusive property or privilege is claimed are defined as follows:

1. A composition of matter comprising a major amount by weight of a hydrocracked lubricating oil and a minor amount by weight of at least one added dihydroxy-diphenyl component having a structure:

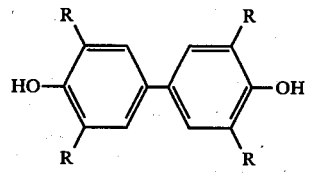

wherein each R is independently selected from the group consisting of monovalent substantially hydrocarbonaceous radicals containing 1 to about 24 carbon atoms, said dihydroxy-diphenyl component being present in an amount effective to inhibit sunlight deterioration of said composition.

2. The composition of claim 1 wherein said hydrocracked lubricating oil comprises at least about 70% by weight of said composition.

3. The composition of claim 2 wherein said R's are independently selected from the group consisting of substantially aliphatic hydrocarbonaceous radicals.

4. The composition of claim 2 wherein said added dihydroxy-diphenyl component comprises about 0.005% to about 2.0% by weight of said composition.

5. The composition of claim 3 wherein said dihydroxy-diphenyl component comprises about 0.01% to about 1.0% by weight of said composition.

6. The composition of claim 2 wherein said dihydroxy-diphenyl component comprises about 0.01% to about 0.5% by weight of said composition.

7. The composition of claim 3 wherein said R's are substantially saturated.

8. The composition of claim 7 wherein each of said R's includes at least one tertiary carbon atom.

9. The composition of claim 3 wherein each of said R's has the same structure and contains 1 to about 10 carbon atoms.

10. The composition of claim 6 wherein each of the R's is tertiary butyl.

11. A method of inhibiting a hydrocracked lubricating oil from deterioration caused by sunlight comprising combining with said oil an inhibiting amount of at least one dihydroxy-diphenyl component having a structure:

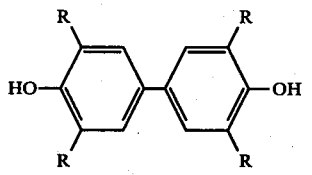

wherein each R is selected from the group consisting of H and substantially monovalent hydrocarbonaceous radicals containing 1 to about 24 carbon atoms.

12. The method of claim 11 wherein said R's are independently selected from the group consisting of substantially aliphatic hydrocarbonaceous radicals.

13. The method of claim 11 wherein said dihydroxydiphenyl component comprises about 0.005% to about 2.0% by weight of said composition.

14. The method of claim 11 wherein said dihydroxydiphenyl component is present in an amount equal to about 0.01% to about 0.5% by weight of said composition.

15. The method of claim 12 wherein said dihydroxydiphenyl component comprises about 0.01% to about 0.5% by weight of said composition.

16. The method of claim 12 wherein said R's are substantially saturated.

17. The method of claim 15 wherein each of said R's includes at least one tertiary carbon atom.

18. The method of claim 16 wherein each of said R's has the same structure and contains 1 to about 10 carbon atoms.

19. The method of claim 17 wherein each of said R's is a tertiary butyl radical.

* * * * *